US008959801B1

(12) United States Patent
Siragusa, Jr.

(10) Patent No.: US 8,959,801 B1
(45) Date of Patent: Feb. 24, 2015

(54) IMPACT FORCE ATTENUATING, ENERGY DISSIPATING ANKLE AND FOOT PROTECTOR ACCESSORY FOR HOCKEY PLAYERS

(76) Inventor: Anthony Siragusa, Jr., Anaheim, CA (US)

( * ) Notice: Subject to any disclaimer, the term of this patent is extended or adjusted under 35 U.S.C. 154(b) by 811 days.

(21) Appl. No.: 13/136,396

(22) Filed: Aug. 1, 2011

(51) Int. Cl.
*A63B 5/00* (2006.01)

(52) U.S. Cl.
USPC ..... 36/72 R; 2/22

(58) Field of Classification Search
USPC ..... 36/1.5, 114, 115, 132, 71, 72 R; 2/22, 2/23, 267
See application file for complete search history.

(56) References Cited

U.S. PATENT DOCUMENTS

| | | | | | |
|---|---|---|---|---|---|
| 1,572,313 | A | * | 2/1926 | Sarar | 36/1.5 |
| 1,844,997 | A | * | 2/1932 | Weigle | 36/1.5 |
| 2,617,207 | A | * | 11/1952 | Jennett | 36/2 R |
| 2,984,917 | A | * | 5/1961 | Saunders | 280/811 |
| 3,153,864 | A | * | 10/1964 | Brewer | 36/2 R |
| 3,416,156 | A | * | 12/1968 | Marvid | 2/22 |
| 4,351,537 | A | * | 9/1982 | Seidel | 280/11.12 |
| 4,445,287 | A | * | 5/1984 | Garcia | 36/106 |
| 4,503,566 | A | * | 3/1985 | Wheeler | 2/22 |
| 4,608,718 | A | * | 9/1986 | Reed | 2/22 |
| 5,172,493 | A | * | 12/1992 | Diaz | 36/2 R |
| 5,234,230 | A | * | 8/1993 | Crane et al. | 280/811 |
| 5,251,386 | A | * | 10/1993 | Diaz | 36/2 R |
| 5,301,370 | A | * | 4/1994 | Henson | 2/22 |
| 5,566,476 | A | * | 10/1996 | Bertrand et al. | 36/72 R |
| 5,613,250 | A | * | 3/1997 | Bell | 2/242 |
| 5,671,478 | A | * | 9/1997 | Yen | 2/22 |
| 5,711,092 | A | * | 1/1998 | Despres et al. | 36/72 R |
| 5,829,170 | A | * | 11/1998 | Lutz, Jr. | 36/72 R |
| 5,898,939 | A | * | 5/1999 | Schramm | 2/22 |
| 5,987,778 | A | * | 11/1999 | Stoner | 36/1.5 |
| 6,269,485 | B1 | * | 8/2001 | Foreman | 2/22 |
| 6,327,710 | B1 | * | 12/2001 | Dunn et al. | 2/22 |
| RE37,887 | E | * | 10/2002 | Yates | 36/133 |
| 6,854,200 | B2 | * | 2/2005 | Hipp et al. | 36/96 |
| 7,523,567 | B1 | * | 4/2009 | McClelland | 36/115 |
| 7,937,852 | B1 | * | 5/2011 | Krehbiel | 36/2 R |
| 8,109,013 | B2 | * | 2/2012 | Parrott | 36/72 R |
| 8,317,639 | B1 | * | 11/2012 | McVan | 473/450 |
| D698,883 | S | * | 2/2014 | Sopel et al. | D21/772 |
| 2003/0046746 | A1 | * | 3/2003 | Norbutt | 2/22 |
| 2003/0196351 | A1 | * | 10/2003 | Hipp et al. | 36/72 R |
| 2008/0155863 | A1 | * | 7/2008 | Shor et al. | 36/2 R |
| 2010/0319098 | A1 | * | 12/2010 | Watt | 2/22 |
| 2012/0180183 | A1 | * | 7/2012 | Mechling et al. | 2/22 |
| 2014/0068831 | A1 | * | 3/2014 | Tinsley | 2/22 |

* cited by examiner

*Primary Examiner* — Danny Worrell
(74) *Attorney, Agent, or Firm* — William L. Chapin

(57) ABSTRACT

An ankle and foot protector accessory for hockey players includes a front flexible vertically elongated rectangular instep protector pad constructed of fabric laminations having formed therebetween a vertical series of laterally elongated pockets, each holding an impact force attenuating shield made of a strip of hard, elastic material such as high density polyethylene (HDPE). Flexible laminated ankle protector pads protruding from opposite vertical sides of the instep protector pad are bendable over opposite sides of a skate and releasably secured by a strap and buckle protruding from opposed pads. Each ankle protector pad has a pocket holding an impact force attenuating shield consisting of a circular meniscus-shaped, outwardly convex shell made of an elastic material such as HDPE, which. reversibly deforms into a concave shape upon impact, thus attenuating forces transmitted to the ankles. Optionally, one or more shields may be backed by a resilient material such as a gel.

16 Claims, 6 Drawing Sheets

IMPACT FORCE ATTENUATING, ENERGY DISSIPATING ANKLE AND FOOT PROTECTOR ACCESSORY FOR HOCKEY PLAYERS

BACKGROUND OF THE INVENTION

A. Field of the Invention

The present invention relates to accessories for use by players engaging in the sport of hockey. More particularly, the invention relates to a protector accessory which fits over the skate of a hockey player to minimize injuries to the foot and ankle of the player.

B. Description of Background Art

Ice hockey has long been a popular group sport for young people to participate in. It is also a very popular spectator sport in which fans can watch their favorite grade school, high school, college or professional hockey teams engage competing teams.

Probably one of the main reasons that people enjoy watching or playing hockey games is the speed at which play occurs. Players accelerate quickly on the ice, and skate between goals at opposite ends of an ice rink at speeds up to 15 miles per hour. A pair of goal nets is positioned at opposite long ends of the ice rink. Goal points are scored by launching a disk-shaped puck made of a very hard rubber into an opponent's net which is guarded by a goalie stationed at the net. The puck is launched by striking it with an L-shaped stick, to thus propel it along the ice or through the air into the goal net.

Originally, hockey sticks were made of a tough hard wood such as ash. Using traditional hard wood sticks, a puck could be accelerated to speeds of about 35 to 45 mph. Thus, it can be easily understood that a hard rubber puck, weighing about 8-10 ounces and traveling at 40 mph. can cause painful injuries if it impacts a player. Since a puck is launched from the surface of an ice rink, the puck generally travels along the surface of the ice or at relatively low elevations above the surface of the ice. Therefore, the most common impact areas of a player who inadvertently gets in the way of a speeding puck are the player's skates, feet and ankles.

Modernly, wooden hockey sticks have been replaced with sticks made of aluminum, fiberglass, or synthetic composite materials. The newer hockey sticks are more durable than the older wooden sticks, and have the advantage of enabling pucks to be launched at much higher speeds. Modern hockey sticks made of such materials are capable of accelerating pucks to speeds as great as twice that attainable with the older wooden sticks, e.g., 70 mph. as opposed to 35 mph. Since the kinetic energy of a moving object is proportional to the square of its velocity, pucks launched with the newer sticks can have kinetic energies of the order of four times that of pucks launched using a wooden hockey stick. Accordingly, the potential for receiving painful and potentially serious injuries from a flying puck in modern hockey games if quite substantial.

The potential for painful if not serious injuries to the feet and ankles exists for all hockey players, and particularly so if they are participants in games in which the newer aluminum or composite sticks are used. The problem of potential injuries exists for both professional hockey players, and members of amateur grade school, high school and college teams. Also, because of the increasing popularity of hockey, there are increasing numbers of amateur hockey players who are not necessarily affiliated with a school or college. Accordingly, there is an increasing need for providing some means of protecting the ankles and feet of hockey players from injuries caused by pucks flying at higher speeds.

One solution to the problem of protecting the ankles and feet of a hockey player from impact injuries caused by flying hockey pucks is to use the obvious expedient of positioning some sort of padding medium over likely and vulnerable impact regions of the feet and ankles. Thus, there have been proposed various sorts of cushioning or padding accessories which are incorporated into the instep and/or ankle side regions of hockey skates, or as parts of straps which may be attached over skates on a player's feet. However, such protective articles have not been widely adopted, for a number of reasons.

One problem with prior art protectors for hockey players' feet and ankles is that some such devices are custom made of expensive materials such as carbon fibers, and, at a cost of several hundred dollars per skate, effectively place such articles beyond the practical reach of most amateur players.

Simpler and cheaper feet protector devices for hockey players have been proposed which utilize an elastomeric insert, or a flowable gel to absorb impact energy of a flying puck. However, these devices have proved ineffective because they generally transmit the full impact shock of a flying puck to parts of the ankle or foot.

The limitations of prior art ankle and foot protectors for hockey players discussed above was a primary motivation for the present invention.

OBJECTS OF THE INVENTION

An object of the present invention is to provide an impact force attenuating accessory which fits over the instep and ankle regions of a skate worn by a hockey player to thereby reduce the magnitude of impact forces exerted by a flying hockey puck on the ankle and foot of a hockey player.

Another object of the invention is to provide an impact force attenuating accessory for hockey players which fits over the skate and includes a vertically disposed front instep protector pad, and two angularly upwardly and rearwardly disposed ankle side protector pads which extend laterally outwardly and upwardly from opposite vertical sides of the instep pad.

Another object of the invention is to provide an impact force attenuating accessory for hockey players which includes a front vertically disposed instep protector pad and a pair of left and right ankle side protector pads that protrude laterally outwards from left and right vertical sides of the instep protector pad, each ankle side protector pad having a pocket which holds therein a force attenuating shield consisting of a convex meniscus-shaped insert shell which is made of an elastically deformable polymer material.

Another object of the invention is to provide an impact force attenuating accessory which is removably attachable to a hockey skate and includes a front vertically disposed instep protector pad and left and right ankle side protector pads that protrude laterally outwards from left and right vertical sides of the instep protector pad, each ankle side protector pad having a pocket containing an outwardly convex meniscus-shaped insert made of an elastically deformable polymer, such as high density polyethylene (HDPE), outer lateral sides of the ankle side protector having protruding laterally outwards therefrom a strap and buckle, respectively, for securing the side ankle protectors in position over the ankle sides of a player's skate.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an impact force attenuating energy dissipating ankle and foot protector accessory which is removably attachable over an ice skate worn by a hockey player, and which protects the ankle and foot of a player from painful and potentially serious injuries which can be caused by a flying hockey puck impacting the feet and ankles of a player.

According to the invention, a pair of identical accessories is provided, each of which is interchangeably attachable over the left or right skate of a hockey player.

Each impact force attenuating energy dissipating ankle and foot protector accessory for hockey players according to the present invention includes a front, flexible vertically elongated rectangular instep protector pad which is positionable over the instep or front lace area of a hockey skate. Preferably, outer corners of left and right upper and lower edges of the instep protector pad have convex, arcuately curved edges, thus giving the instep protector pad in plan view the shape of a vertically oriented race track.

The instep protector pad of the ankle and foot protector accessory according to the present invention preferably is made of a durable, flexible fabric such as ballistic nylon which has inner and outer laminations that have formed therebetween adjacent laterally elongated, rectangularly-shaped pockets. In an example embodiment, the instep protector pad has a lower rectangularly-shaped pocket which has a lower sewn edge located a short distance above the lower eyelets, two intermediate pockets of approximately the same size and shape as the lower pocket located above and spaced apart from the lower pocket, and an upper pocket located above the upper lateral edge of the upper one of the two intermediate pockets. Each pocket contains therein an impact force attenuating shield consisting of a thin, generally rectangularly-shaped strip of a hard, elastically deformable material such as high density polyethylene (HDPE) which is effective in attenuating the impact force of a hockey puck. Optionally, the hard force attenuating strips may be backed by resilient or gel-filled pads.

The arrangement of vertically spaced apart pockets each containing a separate hard insert enables the instep protector pad to be bendable into a rearwardly facing arcuately curved convex shape which is conformable to the concave front lacing area of an ice skate which overlies the instep area of a skater's foot.

In a preferred embodiment of a protective accessory according to the present invention, the instep protector pad has located a short distance above a lower transversely disposed horizontal edge of the pad a pair of horizontally aligned eyelets which are laterally spaced apart from a longitudinal center line of the pad. The eyelets are provided to receive therethrough the bottom horizontally disposed segment of a skate's attaching lace, thus securing the bottom edge of the instep protector pad in position over the lower front portion of the skate's lacing area and the instep of a skater wearing the skate.

Each impact force attenuating, energy absorbing ankle and foot protector accessory also includes a pair of left and right ankle side protector pads which protrude laterally outwards from left and right vertical sides of the front vertically disposed instep protector pad. Each ankle protector pad is flexibly bendable rearward from the instep protector pad, and secureable in place to overlie outer and inner ankle sides of a skater by a strap and buckle which protrude outwardly from outer edges of the ankle protector pads.

Each ankle protector pad of each ankle and foot protector accessory has a pocket in which is contained a force attenuating shield consisting of an outwardly, convex, circular meniscus-shaped insert shell which is made of relatively hard, elastically deformable material such as high density polyethylene (HDPE). The meniscus-shaped HDPE insert shell is reversibly deformable into a concave shape upon being impacted by a flying hockey puck. This deformation is highly effective in absorbing energy from a flying puck, and substantially attenuating impact forces on a skater's ankles. Optionally, the concave rear surface of each meniscus-shaped hard insert may be backed by a resilient or gel-filled pad.

DESCRIPTION OF THE PREFERRED EMBODIMENTS

FIGS. 1-12 illustrate the construction and function of an impact force attenuating energy dissipating ankle and foot protector accessory for hockey players, according to the present invention. The accessory may be removably attached to either the left or right skate worn by a hockey player. Preferably two of the accessories would be used, one for the left skate and one for the right skate.

Figure 1:
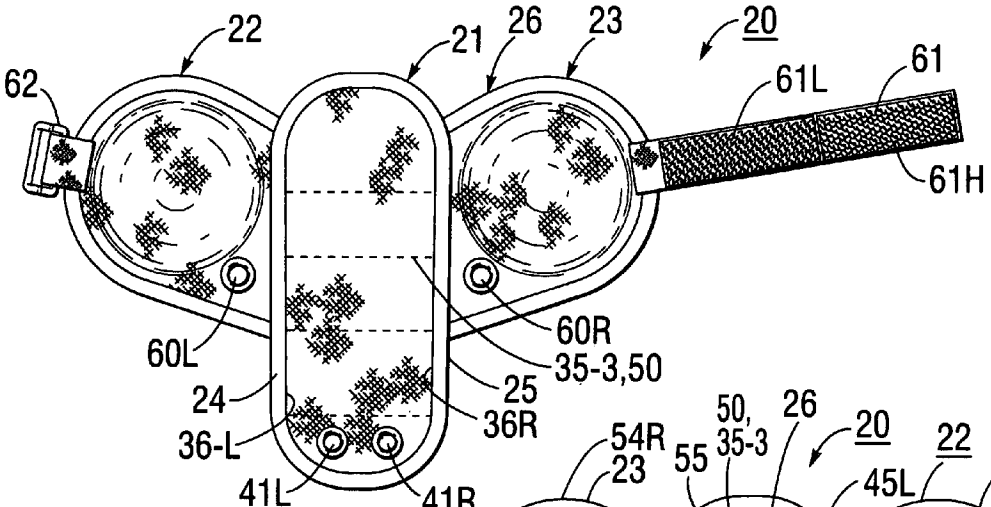
FIG. 1 is a front elevation view of an impact energy dissipating ankle and foot protector accessory for hockey players according to the present invention.
Figure 5:
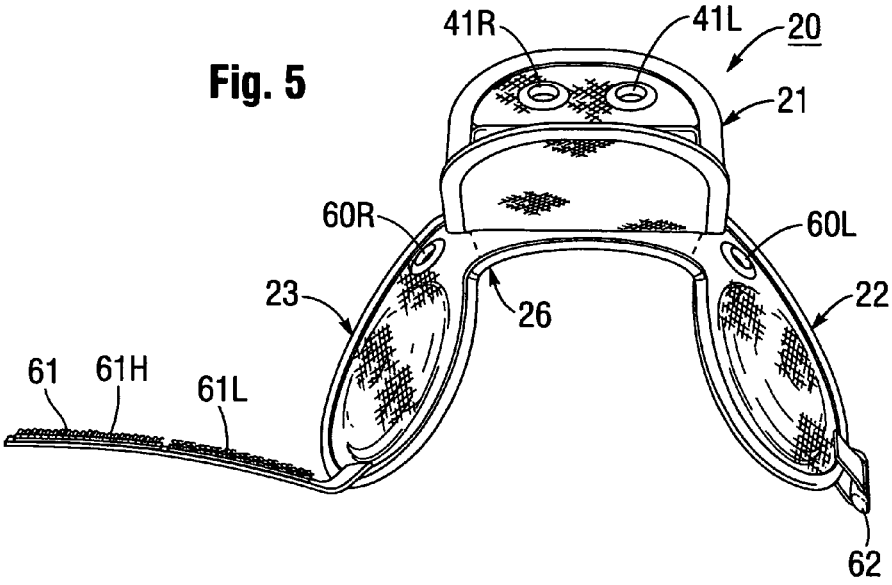
FIG. 5 is an upper rear view of the accessory of FIG. 1, showing ankle protector pads of the accessory flexed rearwardly from the instep protector part of the accessory.
Figure 6:
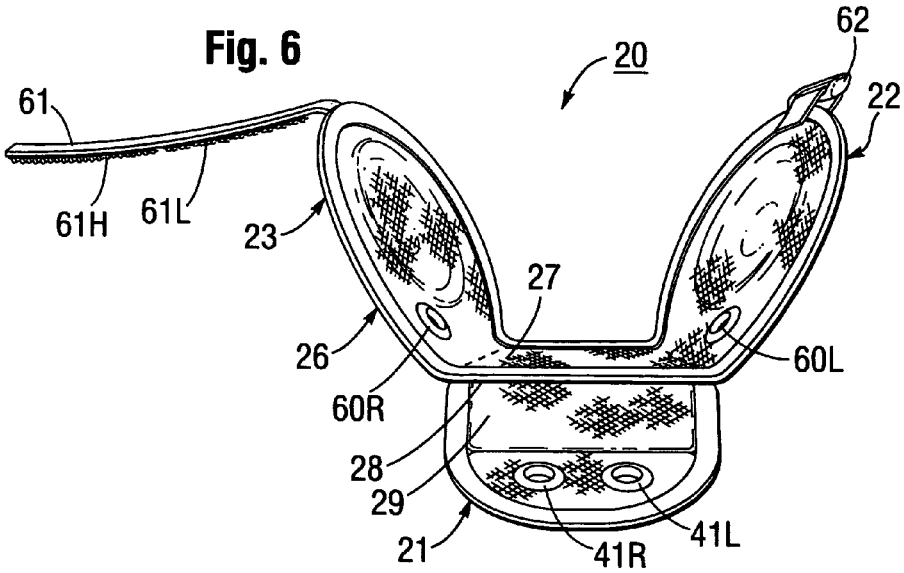
FIG. 6 is a lower rear view of the accessory of FIG. 5.
Figure 7:
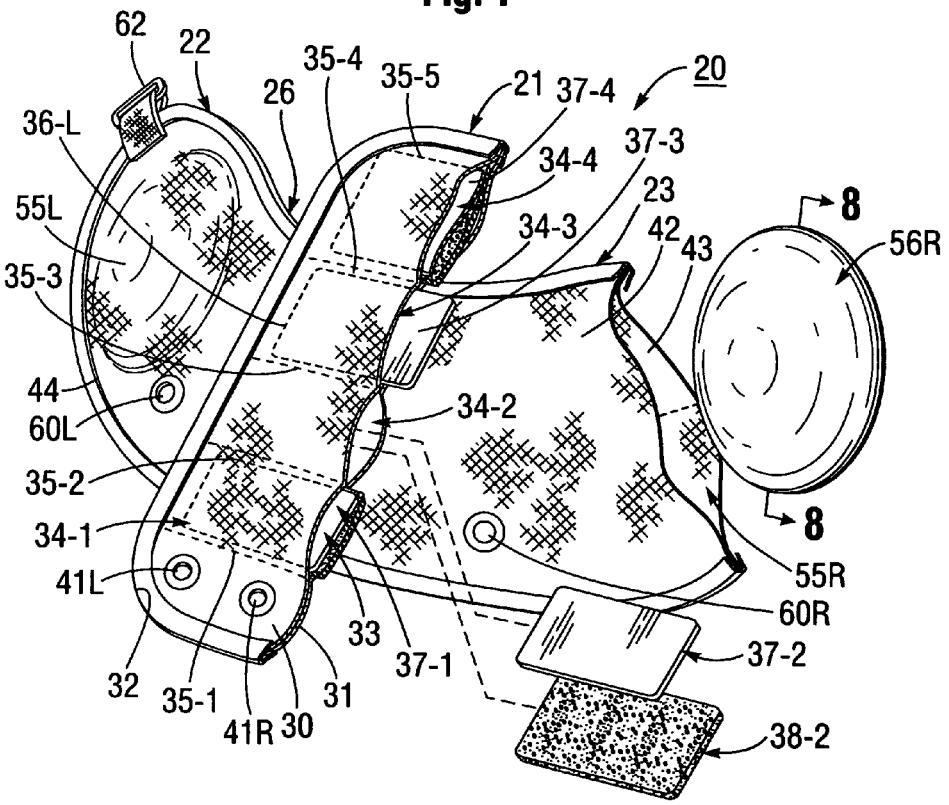
FIG. 7 is a partly broke-away front perspective view of the accessory of FIG. 1, showing both meniscus-shaped insert shells and flat energy absorbing insert strips thereof.

Referring to FIGS. 1-6, it may be seen that an impact force attenuating energy dissipating ankle and foot protector accessory 20 for hockey players includes a front vertically disposed instep protector pad 21, and left and right ankle protector pads 22, 23, respectively, which extend laterally outwards from opposite vertical sides 24, 25 of the instep protector pad. Preferably, as shown in FIGS. 1 and 6, the left and right protector pads 22, 23 are laterally outwardly located parts of a unitary ankle protector component 26. As shown in FIG. 6, ankle protector component 26 has a central generally rectangularly-shaped section 27 which has a flat front surface 28 that is affixed to a flat rear surface 29 of the instep protector pad 21. As may be seen best by referring to FIG. 7, both instep protector pad 21 and left and right ankle protector pads 22, 23 of ankle protector component 26 have a laminated construction. Thus, as shown in FIG. 7, front instep protector pad 21 includes a front lamination 30, and a congruently-shaped rear lamination 31. The front and rear laminations are joined together near the outer peripheral edges thereof by sewn stitching, forming between the front and rear laminations a space 33 having a plan-view shape similar to those of the front and rear laminations.

Front and rear laminations 30 and 31 of instep protector pad 21 are preferably made of a tough, flexible fabric such as ballistic nylon. In an example embodiment of protector 20, the front and rear laminations 30, 31 were both made of:

1680 denier,

Approx. 320 threads per inch 12 ounces/square yard 3M brand ballistic nylon, purchased from Glen Raven Inc., 1831 North Park Avenue, Glen Raven, N.C. 27217-1100, USA.

As shown in FIG. 7, space 33 between inner facing surfaces of front and rear laminations 30, 31 of instep protector pad 21 has the shape of a vertically elongated rectangle. Preferably, as shown in FIG. 1, each of the four corners of instep protector pad 21 have convex, arcuately curved, i.e., radiused edges, thus giving it the shape of a vertically oriented race track.

In a preferred embodiment, the rectangular space 33 within instep protector pad 21 is partitioned into a vertical sequence of parallel laterally elongated rectangularly-shaped pockets 34-1, 34-2, 34-3 and 34-4. The first or lowest pocket 34-1 has a lower horizontally disposed closed edge 35-1 which is preferably formed by a horizontally disposed line sewn threaded stitching line. Lowest pocket 34-1 also has an upper horizontally disposed edge 35-2 which serves as the lower edge for the second pocket 34-2. Similarly, second pocket 34-2 has an upper edge 35-3 which is co-extensive with the lower edge of third pocket 34-3, third pocket 34-3 and has an upper edge 35-4 which is co-extensive with the lower edge of fourth, uppermost pocket 34-4, which has an upper sewn edge 35-5. As shown in FIG. 7, pockets 34 have a common vertically disposed left edge which also is a sewn joint 36-L.

Referring still to FIG. 7, it may be seen that each pocket 34 of instep protector pad 21 contains an impact absorbing protective insert strip 37. Each protective insert strip 37 consists of thin, laterally elongated, rectangular strip which is made of a tough, flexible material such as high density polyethylene (HDPE). In an example embodiment, each insert strip 37 was made of an inch thick strip of Prime HDPE 250, obtained from Primex Plastics Corporation, 65 River Drive, Garfield, N.J. 07026 USA. As shown in FIG. 7, some or all of the pockets 34 of instep protector 21 may optionally include an additional insert 38 located between the rear surface of an insert 37 and the front, inner facing surface 30L of rear lamination sheet 31. Insert 38 is made of a resilient material such as Prime HDPE 250 or a capsule filled with a gel such as 150 Gel, Stock # 19661, obtained from Impact Gel Equine, 1540 Heritage Blvd., Suite 201A, West Salem, Wis. 54669

As shown in FIG. 1, the right vertical edges of pockets 34 are closed by a common vertically disposed sewn joint 36-R. As is also shown in FIGS. 1 and 7, instep protector 21 preferably has a pair of horizontally aligned grommets or eyelets 40L, 41R which are spaced equidistant from opposite sides of a vertical center line and are located a short distance above the lower edge of the instep protector pad 21.

Figure 2:
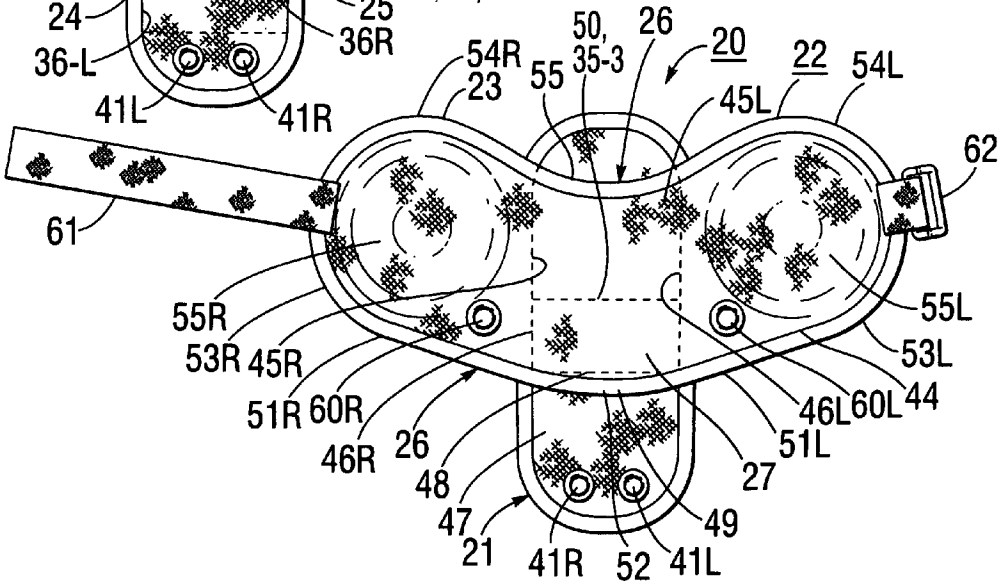
FIG. 2 is a rear elevation view of the accessory of FIG. 1.
Figure 3:
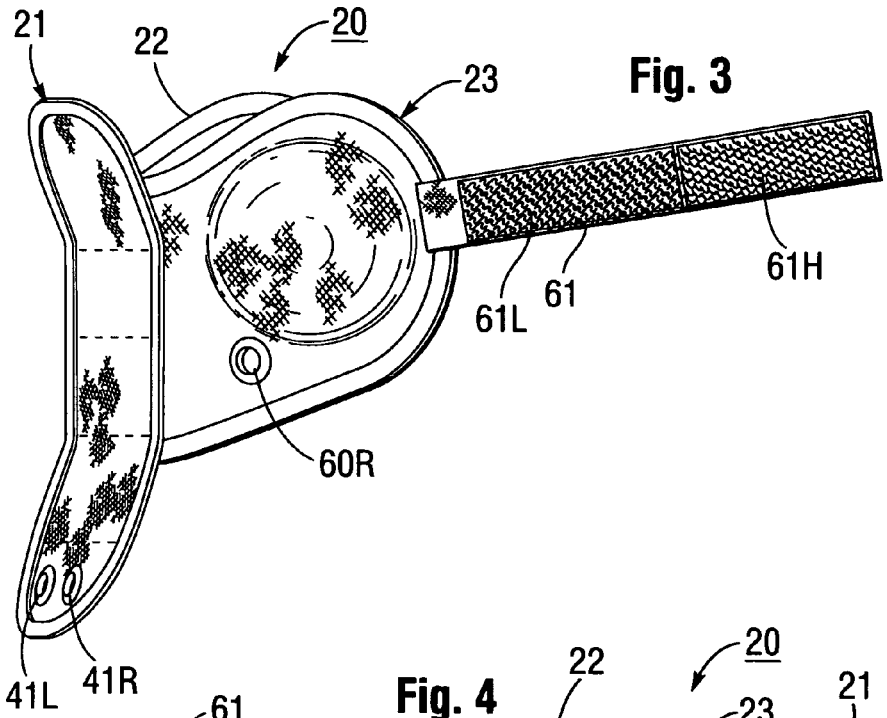
FIG. 3 is a left side perspective view of the accessory of FIG. 1, showing ankle protector pads of the accessory flexed rearwards.
Figure 4:
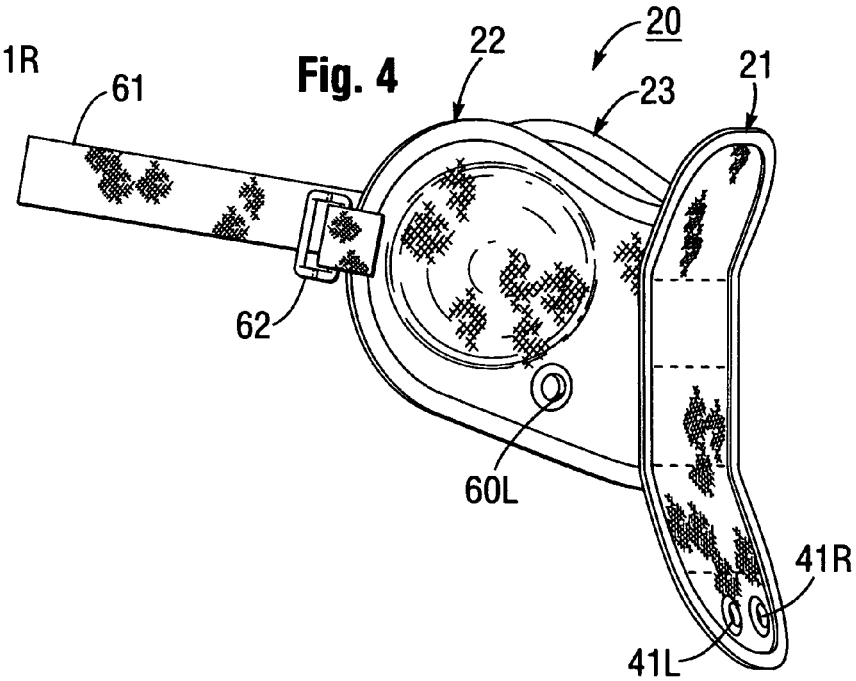
FIG. 4 is a right side perspective view of the accessory of FIG. 3.

Referring now to FIGS. 2 and 7, ankle protector component 26 of ankle and foot protector accessory 20 includes a front lamination 42 and a congruent rear lamination 43 which are joined together near outer peripheral edges thereof, preferably by a peripheral stitched joint 44 which is parallel to and located a short distance inwards of the outer peripheral edges of the laminations, forming between the front and rear laminations a space 44.

As shown in FIG. 2, left and right ankle protector pads 22, 23 have an identical shape. Each pad 22, 23 has a straight vertical inner edge 45L, 45R which joins left and right outer edges 46L, 45R of rectangular central section 27 of ankle protector component 26. As shown in FIG. 2, a lower end of rectangular central section 27 of ankle protector component 26 is joined to the rear surface 47 of insert protector pad 21 by a horizontally disposed sewn stitched joint 48 which is located a short distance above and parallel to the lower edge 49 of the central section 27. Preferably lower stitched joint 48 of ankle protector pad central section 27 is coextensive with the upper stitched joint 35-2 of lowest insert pocket 34-1 of instep protector pad 21.

Referring still to FIG. 2, it may be seen that rectangular central section 27 of ankle protector component 26 is joined to rear surface 47 of instep protector pad 21 by a second horizontal stitched joint 50, which is located above and parallel to first, lower stitched joint 48. Preferably, stitched joint 50 is coextensive with the upper stitched joint 35-3 of second insert pocket 34-1 of instep protector pad 21. This second joint 50 is located at a distance of about one-third the height of the rectangular central section 27 of ankle protector pad component 26. Thus located, second, upper ankle protector joint 50 serves as a horizontally disposed self-hinge line which enables the upper part of the central section 27 to be flexed rearwardly from the instep protector pad 21, as shown in FIG. 5.

Referring to FIG. 2, it may be seen that left and right ankle protector pads 22, 23 of ankle and foot protector accessory 20 have lower generally straight edges 51L, 51R which extend obliquely outwards and upwards from the bottom edge 52 of central section 27 of ankle protector component 26. Outer ends of obliquely upwardly and outwardly angled edges 51L, 51R are tangent to generally semi-circularly-shaped left and right pad sections 53L, 53R of left and right protector pads 22, 23, respectively. Semi-circular pad sections 53L, 53R in turn have upper arcuately curved, convex edges 54L, 54R which extend inwardly towards central rectangular section 27 of ankle protector component 26, and arcuately join the arcuately curved concave upper edge 55 of the central rectangular section.

Figure 8:
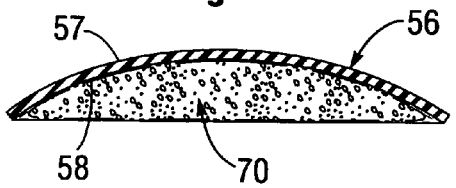
FIG. 8 is a medial longitudinal sectional view of the meniscus insert shell of FIG. 7, showing in phantom a optional resilient or gel filled backing pad.

As may be best understood by referring to FIGS. 1, 2 and 7, the laminated construction of ankle protector component 26 of protector accessory 21 forms between the common front and rear laminations 42,43 of left and right ankle protector pads 22, 23, left and right generally circular plan-view pockets 55L, 55R. As shown in FIG. 7, each pocket 55L, 55R holds therein a force attenuating insert 56L, 56R. As shown in FIG. 8, each force attenuating insert 56 has the shape of a section of a thin spherical shell which has a convex outer surface 57 and concave inner surface 58 which is concentric with and generally parallel to the outer convex surface, thus giving the insert the shape of a meniscus. Insert shell 56 is made of a hard, elastically deformable material such as a synthetic polymer. In an example embodiment of accessary 20, each shell 56 was made of Prime HDPE 250 which had a density of 0.950 grams/cc, an outer radius of curvature of 3.2807 inches, an inner radius of curvature of 3.2207 inches, a thickness of 0.060 inch, and a base diameter of 3.25 inches.

As shown in FIGS. 1 and 2, ankle protector component 26 of ankle and foot protector accessory 20 preferably has a pair of horizontally aligned grommets or eyelets 60L, 60R which penetrate left ankle protector pad 22 and right ankle protector pad 23, respectively. Grommets 60L, 60R are located laterally outwards of left and right outer vertical side edges 46L, 46R of instep protector pad 21, a short distance above lower obliquely upward angled edges 51L, 51R of left and right protector pads 22, 23.

As is also shown in FIGS. 1 and 2, each ankle and foot protector accessory 20 has a flexible strap 61 which extends outwardly from an outer vertical edge of an ankle protector pads, such as right ankle protector pad 23, and a buckle 62 for releasably securing an end of strap 61, the buckle protruding from an outer vertical edge of the other ankle protector pad, such as left ankle protector pad 22.

As shown in FIG. 1, strap 61 preferably has an inner longitudinally disposed half 61L which has on a front surface thereof a loop-pile fabric strip of a hook-and-loop fastener, and an outer longitudinally disposed half which has a hook-type fastener strip 61H. With this arrangement, strap 61 may be secured to buckle 62 by inserting outer end 61H through the eye of the buckle, looping outer hook-end 61H back towards inner loop-end 61L, and pressing parts 61H and 61L together.

Figure 9:
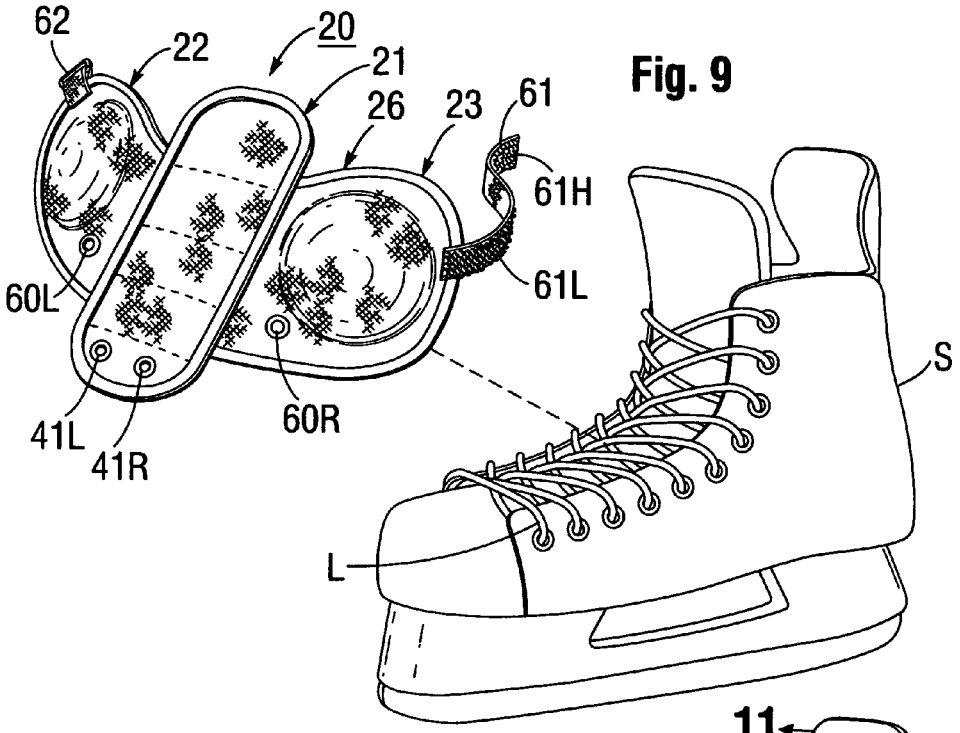
FIG. 9 is a front perspective view of the accessory of FIG. 1 located in a position preparatory to attaching the accessory to an ice skate.
Figure 10:
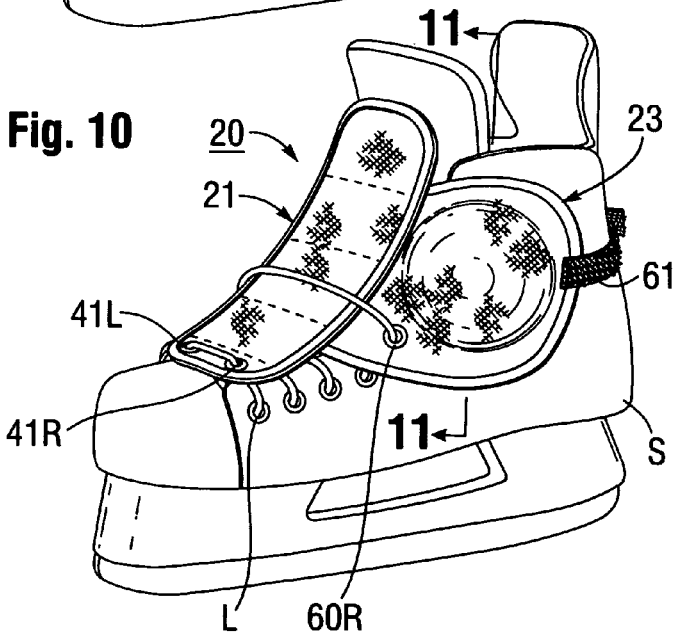
FIG. 10 is a view similar to that of FIG. 9, showing the accessory attached to an ice skate.

FIGS. 9 and 10 illustrate how ankle and foot protector accessory 20 is releasably fastened to an ice skate worn by a skater. First, as shown in FIG. 9, accessory 20 is positioned in front of a skate placed on a skater's foot, with instep protector pad 21 aligned with the front lacing area of the skate that overlies the instep region of the skater's foot. As shown in FIGS. 3-6, the flexible construction of instep protector pad 21 facilitates flexibly bending the pad into a rearwardly convex contour which is conformable to the front concave contour of the instep/lace part of a skate. As is also shown in FIGS. 3-6, the flexible self-hinge regions between ankle protector pads 22, 23 and left and right edges of central section 27 of ankle protector component 26, enable the ankle protector pads to be flexed rearwardly over the outer and inner ankle regions of the skate, as shown in FIG. 10.

Next, instep protector pad 21 of accessory 20 is fitted conformally over the front lacing area of a skate S, and a lace L is threaded through a first lower eyelet of the skate, through eyelets 41L, 41R of the instep protector pad and through a second lower skate eyelet. The lace is then threaded through upper eyelets of the skate in a customary fashion. Optionally, as the lace is threaded through progressively higher eyelet pairs of skate S, the lace may be threaded through eyelets 60L, 60R of left and right ankle protector pads 22, 23 and over instep protector pad 21, to further secure accessory 20 to skate S. Finally, as shown in FIG. 10, strap 61 of accessory 20 is flexed around the rear ankle portion of skate S, inserted through buckle 62, and cinched tightly, whereupon hook portion 61H of the strap pis pressed into loop portion 61L of the strap to secure it in place on the skate and foot of a skater.

Figure 12:
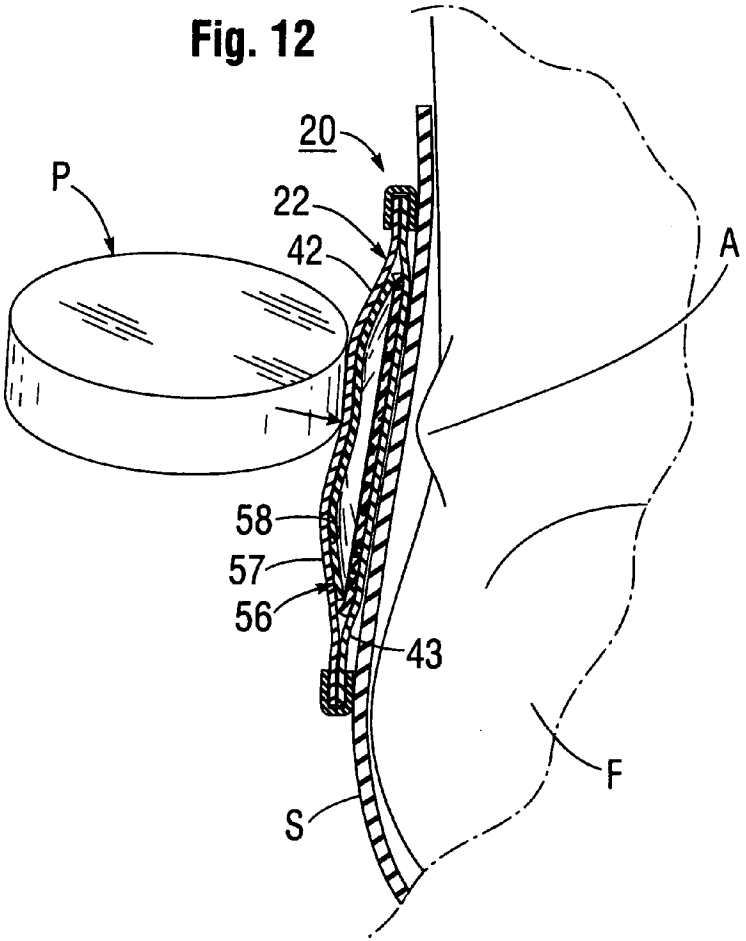
FIG. 12 is a view similar to that of FIG. 11, but showing a convex energy dissipating meniscus insert shell thereof elastically and reversibly deformed to a concave shape in response to an impact force exerted by a flying puck.
Figure 11:
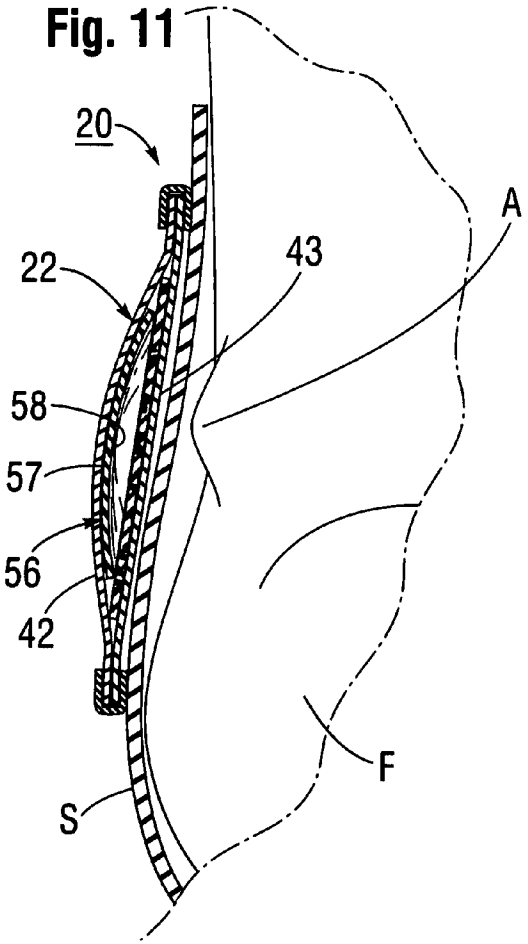
FIG. 11 is a vertical longitudinal sectional view of the accessory of FIG. 9, showing the relation of a skaters angle side relative to a convex energy dissipation meniscus insert shell of the accessory.

FIGS. 11 and 12 illustrate the function of meniscus-shaped force attenuating shell inserts 56L, 56R of left and right ankle protector pads 22, 23. As shown in those figures, when a hockey puck P strikes a skate with sufficient force, the outer surface of an ankle protector, such as left ankle protector pad 22, the outer convex surface 57 of insert shell 56 deforms temporality and elastically to a concave contour, while concave inner surface 58 of the shell deforms to a convex shape. This deformation has been found to greatly reduce the magnitude of an impulsive force which would otherwise be transmitted through the skate to the ankle A of a foot F. The force attenuation is believed to be the result of absorption of a substantial amount of energy from the impacting puck, the energy being required for deforming shell 56.

When the impulsive force exerted on ankle protector pad 22 by puck P terminates, as the puck rebounds from the ankle protector pad after impacting it, shell 56 reversibly reforms to its original outwardly convex shape, thus dissipating deformation energy in an outer direction.

FIG. 8 illustrates an optional gel-filled backing pad 70 which may be located in an ankle protector pocket 55. As shown in FIG. 8, gel-filled backing pad 70 preferably has the shape of a spheroidal section which fits conformally into the concave rear interior space of meniscus-shaped shell 56.

What is claimed is:

1. A protective accessory for reducing impact injuries to the ankle and foot region of a hockey player caused by a flying puck, said accessory comprising;

a. an instep protector pad, said instep protector pad having a vertically elongated, generally rectangular shape having upper and lower transverse edges and including at least a first, outer flexible lamination having fixed with respect thereto at least a first relatively harder impact absorbing shield, and a second, inner flexible lamination attached to a rear, inner surface of said first, outer lamination inwardly of a rear, inner surface of said first impact absorbing shield, b. an ankle protector attached to said instep protector pad, and c. a fastener assembly for releasably attaching said accessory to a skate worn by a skater with said instep protector pad overlying a front lacing area of a skate overlying an instep region of a skater's foot, and said ankle protector pad overlying at least one of an inner and outer side ankle region of said skater.

2. The accessory of claim 1 wherein said impact absorbing shield is further defined as a thin polymer sheet.

3. The accessory of claim 2 wherein said polymer is polyethylene.

4. The accessory of claim 1 wherein said inner and outer laminations have formed between inner facing opposed surfaces thereof at least a first pocket holding said first impact absorbing shield.

5. The accessory of claim 4 further including at least a second pocket holding a second impact absorbing shield, said second pocket and impact absorbing shield being positioned between said inner and outer laminations at a location spaced apart from said first pocket and impact absorbing shield.

6. The accessory of claim 4 wherein said second pocket is located between an upper transverse edge of said first pocket and said upper transverse edge of said instep protector pad.

7. A protective accessory for reducing impact injuries to the ankle and foot region of a hockey player caused by a flying puck, said accessory comprising;

a. an instep protector pad, b. an ankle protector attached to said instep protector pad, said ankle protector having a first ankle protector pad which protrudes outwardly of a first outside longitudinal edge of said instep protector pad, a second ankle protector pad which protrudes outwardly of a second outside longitudinal edge of said instep protector pad spaced laterally apart from first longitudinal edge of said instep protector pad, and a central generally rectangularly-shaped anchor section which has first and second opposed vertical outer edges flexibly joined to opposed inner vertical sides of said first and second ankle protector pads, each of said first and second ankle protector pads including in combination;

i. a first, outer flexible ankle protector lamination, ii. a second, inner flexible ankle protector lamination overlain congruently by said outer lamination, iii. a pocket formed between inner facing surfaces of said inner and outer ankle protector lamination, and iv. an impact absorbing ankle protector shield contained in said pocket.

8. The accessory of claim 7 wherein said impact absorbing ankle protector shield is further defined as having the shape of an outwardly convex, arcuately curved shell made of a relatively hard, elastically deformable material.

9. The accessory of claim 8 wherein said shield is further defined as having a generally uniform thickness.

10. The accessory of claim 8 wherein said shield is further defined as having generally a circular plan view.

11. The accessory of claim 10 wherein said shield is further defined as having generally the shape of a circular meniscus.

12. The accessory of claim 11 wherein said shield is further defined as being made of a polymer.

13. The accessory of claim 11 wherein said polymer is high density polyethylene.

14. The accessory of claim 8 further including a pad made at least in part of a resilient material and located behind at least one of said impact absorbing shields of said instep protector pad and a concave inner space of a said ankle protector shield.

15. The accessory of claim 14 wherein said pad is composed at least in part of a gel.

16. A protective accessory for reducing impact injuries to the ankle and foot region of a hockey player caused by a flying puck, said accessory comprising;

a. an instep protector pad, said instep protector pad having a vertically elongated, generally rectangular shape having upper and lower transverse edges and including at least a first, outer flexible lamination having fixed with respect thereto at least a first relatively harder impact absorbing shield, and a second, inner flexible lamination attached to a rear, inner surface of said first, outer lamination inwardly of a rear, inner surface of said first impact absorbing shield, b. an ankle protector attached to said instep protector pad, said ankle protector having a first ankle protector pad which protrudes outwardly of a first outside longitudinal edge of said instep protector pad, a second ankle protector pad which protrudes outwardly of a second outside longitudinal edge of said instep protector pad spaced laterally apart from first longitudinal edge of said instep protector pad, and a central generally rectangularly-shaped anchor section which has first and second opposed vertical outer edges flexibly joined to opposed inner vertical sides of said first and second ankle protector pads, each of said first and second ankle protector pads including in combination;

i. a first, outer flexible ankle protector lamination, ii. a second, inner flexible ankle protector lamination overlain congruently by said outer lamination, iii. a pocket formed between inner facing surfaces of said inner and outer ankle protector lamination, and iv. an impact absorbing ankle protector shield contained in said pocket, and c. a fastener assembly for releasably attaching said accessory to a skate worn by a skater with said instep protector pad overlying a front lacing area of a skate overlying an instep region of a skater's foot, and said ankle protector pad overlying at least one of an inner and outer side ankle region of said skater.

* * * * *